United States Patent [19]

Clarke

[11] 4,023,669

[45] May 17, 1977

[54] CONVEYOR SYSTEMS FOR CIGARETTES AND THE LIKE

[75] Inventor: Peter Alec Clarke, London, England

[73] Assignee: Molins Limited, London, England

[22] Filed: Mar. 27, 1975

[21] Appl. No.: 562,396

[30] Foreign Application Priority Data

Mar. 29, 1974 United Kingdom ..... 13970/74

[52] U.S. Cl. ..... 198/573; 198/347

[51] Int. Cl.² ..... B65G 43/08

[58] Field of Search ..... 198/20 R, 20 C, 21, 198/22 R, 37, 40, 76, 110, 83, 81, 356, 347, 358, 502, 571–573, 577; 200/61.04, 61.06, 61.07, 61.2, 61.21, 81.9 R, 83 Q, 83 J, 83 W, 85 R; 73/406, 317; 131/21 R, 21 B

[56] References Cited

UNITED STATES PATENTS

| | | | |
|---|---|---|---|
| 2,260,661 | 10/1941 | Enderud | 73/317 |
| 3,286,053 | 11/1966 | Capra | 200/61.21 |
| 3,561,585 | 2/1971 | McCombie | 198/37 |
| 3,625,340 | 12/1971 | McCombie | 198/40 |
| 3,885,683 | 5/1975 | Bornfleth et al. | 198/37 |

*Primary Examiner*—Evon C. Blunk
*Assistant Examiner*—Joseph E. Valenza
*Attorney, Agent, or Firm*—Craig & Antonelli

[57] ABSTRACT

A conveyor system for cigarettes and similar rod-like articles includes a sensor device above a junction between a plurality of cigarette conveyors, the sensor device comprising a horizontal arm to which is pivoted a plate resting on the cigarettes in the junction. Movement of the arm may be transmitted to a rotary regulator for controlling one of the conveyors, the regulator being coupled to the arm by means of a pin and slot connection.

9 Claims, 1 Drawing Figure

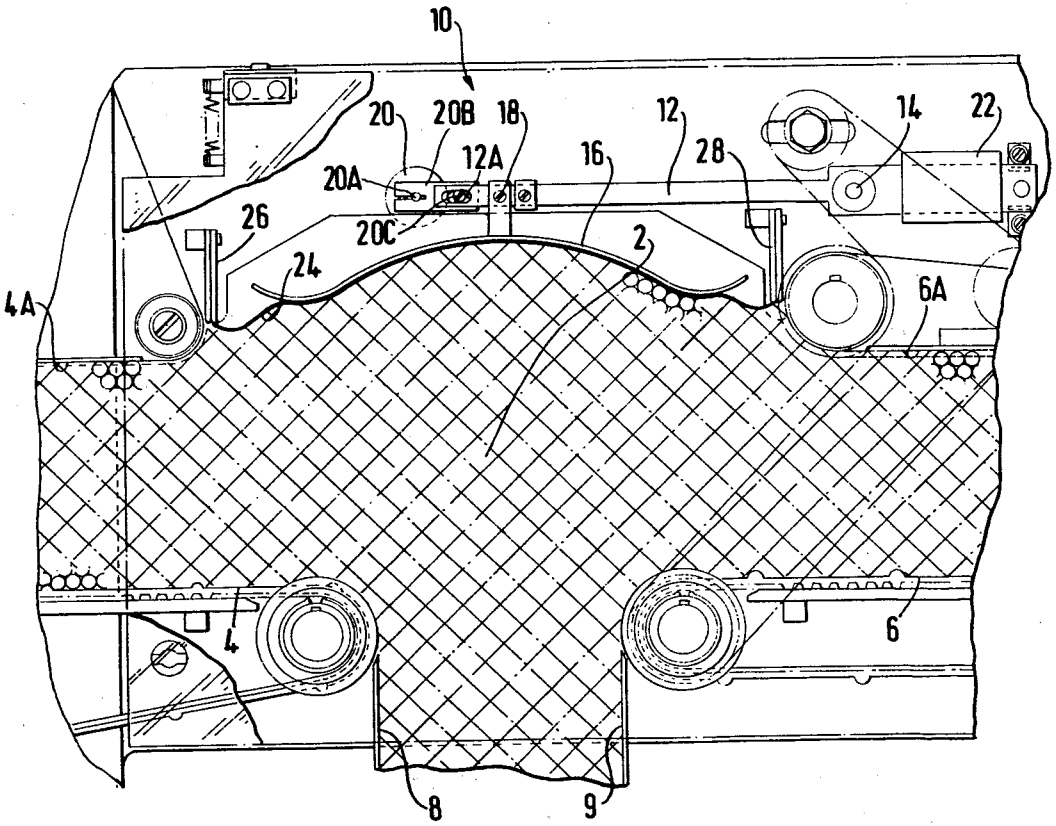
10
22
14
28
12
16
18
12A
20B
20
20A
20C
26
24
2
6A
6
9
8
4
4A

CONVEYOR SYSTEMS FOR CIGARETTES AND THE LIKE

This invention is concerned particularly with sensor devices for use above a junction zone between two conveyors carrying stacks of cigarettes or similar rod-like articles (e.g. cigarette filter rods), the sensor device being arranged to control the delivery of cigarettes to or from the junction, either unidirectionally or reversibly, by one of the conveyors.

According to one aspect of this invention the sensor device comprises an approximately horizontal arm which is pivotally mounted about a first horizontal axis, a plate which is pivoted to the arm about a second axis parallel to but remote from the first axis and which includes a portion extending from the second axis in a direction generally towards the first axis, and a portion extending from the second axis in a direction generally away from the first axis, so as to present a substantial bottom surface to rest on cigarettes in the junction zone, and a control device which responds to the position of the arm for controlling one of the conveyors.

The plate may be approximately symmetrical about a vertical plane through the second axis. It may be shaped so as to present a generally concave underneath surface to the cigarettes below it (viewed in the direction of the cigarette axes), but with slightly upturned ends.

The plate may rest directly on the cigarettes in the junction zone. However, in a preferred arrangement, there is a membrane which lies over the junction zone and confines the cigarettes in the junction zone, and the plate itself rests on the membrane. Such an arrangement is the subject of U.S. application Ser. No. 354,076, filed Apr. 24, 1973.

According to a second aspect of this invention, which may be used separately or in combination with the first aspect of this invention, a sensor device comprises an arm pivoted about a first horizontal axis; a rotary regulator for controlling the speed and possibly the direction of one of the conveyors, the regulator having a spindle with its axis parallel to but remote from the first axis, and including a crank mounted on the spindle; and means connecting the crank to the arm whereby movement of the arm about the first axis results in rotation of the spindle. The connecting means preferably comprises a pin and slot connection which may, for example, comprise a pin on the crank which engages in a longitudinal slot in the arm.

This second aspect of the invention provides a useful connection between the arm and the regulator without placing an excessive load on the bearings of the regulator such as would occur, for example, if the arm itself were mounted directly on the regulator spindle. Furthermore, the distance of the pin from the first axis may be, and preferably is, considerably greater than the distance from the axis of the spindle, so that movement of the arm through a given angle results in a larger angle of movement of the crank.

An example of a sensor device according to this invention is shown in the accompanying drawing.

The sensor shown in the drawing may, for example, be used in place of the sensor 95 shown in FIG. 6 or in FIG. 12 of U.S. application Ser. No. 408,256, filed Oct. 23, 1973 or in place of the sensor 40 in FIG. 3 of that application.

The sensor is arranged to monitor the flow of cigarettes to or from a junction 2. The function of the sensor will be described in relation to the context of FIG. 6 or FIG. 12 of the last-mentioned patent application. Horizontal band conveyors 4 and 6 deliver stacks of cigarettes to or from the junction 2, both conveyors being reversible, and there is a downwardly extending channel formed by walls 8 and 9 which may lead to a buffer reservoir as described in the last-mentioned patent application. The conveyor speed regulating function of the sensor is described in the last-mentioned application.

The sensor, which is identified generally by the reference numeral 10, comprises an approximately horizontal arm 12 which is pivoted on a horizontal pivot pin 14, a plate 16 which is pivoted to the arm by a horizontal screw 18, and a conveyor speed regulator 20. The regulator 20 has a spindle 20A which carries a crank 20B on which there is a pin 20C engaging in a longitudinal slot 12A in the arm. Thus movement of the arm 12 about its pivot 14 results in rotation of the spindle 20A of the regulator 20. The regulator 20 may control the speed of one of the conveyors 4 and 6 or of conveyors (not shown) forming side walls of the buffer reservoir below the junction.

A counterweight 22 is mounted on the arm, to the right of the pivot pin 14, so that the cigarettes in the junction 2 do not have to bear the full weight of the arm and plate. The position of the counterweight 22 along the arm may be adjustable.

The cigarettes are confined in the junction zone by a membrane 24 which is clamped at opposite ends by clamping plates 26 and 28.

The plate 16 is shown at approximately the middle of its range of upward and downward movement. During use, it moves upwards or downwards in accordance with the quantity of cigarettes in the junction 2. The plate provides a relatively firm ceiling for the cigarettes in the junction, but in view of the fact that it is pivoted to the arm it can accommodate any occasional tendency for cigarettes to build up more rapidly at one side of the junction than at the other side. When, for example, the level of cigarettes on one side of the junction rises or falls by a given amount without the other side being significantly affected, the plate does move the arm slightly, but less than it would do if it were rigidly secured to the arm. Movement of the arm tends to reflect changes in the total quantity of cigarettes in the junction. Nevertheless, the plate provides a substantial swept volume giving a useful buffer effect.

The bands 4 and 6 each carry a stack of cigarettes and have cooperating top bands 4A and 6A which define the upper surfaces of the stacks. The top bands 4A and 6A are driven respectively in the same direction and at the same speed as the bands 4 and 6.

I claim:

1. A conveyor system for cigarettes and similar rod-like articles, including two conveyors which extend in opposite directions from a junction zone and each of which is arranged to carry a stack of cigarettes towards or from the junction zone, and sensor means located above the junction zone for controlling the speed of one of said conveyors, said sensor means comprising an arm, support means for mounting said arm with an approximately horizontal disposition pivotally about a first horizontal axis, a plate which is pivotally connected to the arm about a second axis parallel to but remote from said first axis and which includes a portion extending from the second axis in a direction generally towards the first axis, and a portion extending from the second axis in a direction generally away from the first axis, so as to present a substantial bottom surface to rest on cigarettes in the junction zone, said plate being approximately symmetrical about a vertical plane through said second axis, the underneath surface of said plate, when viewed in the direction of the cigarette axis, being generally concave but with slightly upturned ends, and control means responsive to the position of said arm for controlling said one conveyor, said control means being connected near one end of said arm and said support means being connected near the other end of said arm, said plate being connected to said arm at a point therebetween.

2. A conveyor system acording to claim 1 in which the cigarettes in the junction zone are confined in the junction zone by a membrane on which the plate of said sensor means rests.

3. A conveyor system according to claim 1 in which said control means comprises rotary regulator means for controlling the speed and the direction of movement of the associated conveyor, said regulator means having a spindle with its axis parallel to but remote from the first and second axes of said sensor means and including a crank which is mounted on the spindle and is connected to the arm whereby movement of the arm about the first axis results in rotation of the spindle.

4. A conveyor system according to claim 3, wherein said crank is connected to said arm by a pin and slot connection.

5. A conveyor system for cigarettes and similar rod-like articles, including first and second conveyors which extend in opposite directions from a junction zone and each of which is arranged to carry a stack of cigarettes towards or from the junction zone, means including a third conveyor for conveying a stack of cigarettes vertically downwards from the junction zone, and sensor means located above the junction zone for controlling one of said conveyors, said sensor means comprising an approximately horizontal arm which is pivotally mounted about a first horizontal axis, a plate having a middle portion which is pivoted to the arm about a second axis parallel to but remote from the first axis and including end portions on opposite sides of the middle portion and extending slightly downwards from the middle portion to provide the plate with an underneath surface which is generally concave but with upturned ends lying respectively approximately above the ends of said first and second conveyors extending in opposite directions from the junction zone, the plate being arranged to rest on the cigarettes in the junction zone, and control means coupled to said arm for controlling said one conveyor in response to upward and downward movement of the arm about said first axis.

6. A conveyor system according to claim 5, in which said control means comprises rotary regulator means for controlling the speed and the direction of movement of the associated conveyor, said regulator means having a spindle with its axis parallel to but remote from the first and second axes of said sensor means and including a crank which is mounted on the spindle and is connected to the arm whereby movement of the arm about the first axis results in rotation of the spindle.

7. A conveyor system according to claim 6, wherein said crank is connected to said arm by a pin and slot connection.

8. A conveyor system according to claim 7, wherein the distance of the pin from said first axis is considerably greater than the distance of the pin from the axis of the spindle.

9. A conveyor system according to claim 8, wherein said crank is connected to said arm at the end of said arm on the opposite side of said second axis from said first axis.

* * * * *